US005376142A

United States Patent [19]

Matthews et al.

[11] Patent Number: 5,376,142

[45] Date of Patent: Dec. 27, 1994

[54] METHOD TO TREAT ANIMAL SKINS PRIOR TO TANNING

[75] Inventors: Nigel S. Matthews, Worcester; Graham R. Lloyd, Brewood, both of Great Britain

[73] Assignee: Albright & Wilson Limited, Oldbury, England

[21] Appl. No.: 64,169

[22] PCT Filed: Sep. 25, 1992

[86] PCT No.: PCT/GB92/01769

§ 371 Date: Aug. 3, 1993

§ 102(e) Date: Aug. 23, 1993

[87] PCT Pub. No.: WO93/06249

PCT Pub. Date: Apr. 1, 1993

[30] Foreign Application Priority Data

Sep. 27, 1991 [GB] United Kingdom ..... 9120652.4

[51] Int. Cl.[5] ..... C14C 1/08; C14C 11/00

[52] U.S. Cl. ..... 8/94.18; 8/94.15; 252/8.57

[58] Field of Search ..... 8/94.18, 94.21, 94.15; 106/18.18, 18.19; 427/389; 252/8.57

[56] References Cited

U.S. PATENT DOCUMENTS 3,104,151 9/1963 Windus et al. ..... 8/94.33
3,734,684 5/1973 Donaldson et al. ..... 8/183

FOREIGN PATENT DOCUMENTS 0122894 10/1984 European Pat. Off. .
764312 12/1956 United Kingdom .

*Primary Examiner*—Prince Willis, Jr.
*Assistant Examiner*—Alan D. Diamond
*Attorney, Agent, or Firm*—Frishauf, Holtz, Goodman & Woodward

[57] ABSTRACT

A method for treating animal skins, prior to tanning including contacting animal skins with an aqueous degreasing solution containing brine and an effective amount of a shrink inhibitor, the shrink inhibitor being (a) at least one hydroxyalkyl phosphine compound of the formula $$(HORPR_n^1O_m)_xX_y$$

wherein

R is a $C_1$–$C_{24}$ alkyl or a $C_1$–$C_{24}$ alkylene;
$R^1$ is a $C_1$–$C_{26}$ alkyl, a $C_1$–$C_{24}$ alkenyl or ROH;
X is an anion, whereby the hydroxyalkyl phosphine compound is at least sparingly soluble in water;
x is a whole number equal to the valency of X;
n=2 or 3 and m=0 or 1, whereby (n+m)=2 or 3;
y=0 or 1, whereby (n+y)=2 or 4; or (b) a condensate of at least one of the compound (a), the condensate being at least sparingly water-soluble.

17 Claims, No Drawings

METHOD TO TREAT ANIMAL SKINS PRIOR TO TANNING

This application is a 371 of PCT/GB92/01769 filed Sep. 25, 1992.

The present invention relates to the use of hydroxyalkyl phosphine compounds in the production of leather.

Animal skins, being predominantly protein, are subject to decomposition by microorganism and autolysis. The increased mechanical, chemical and biological stability which leather possesses in comparison to fresh skins or hides results primarily from the tanning operation, in combination with various finishing processes which make the leather acceptable to the purchaser. Tannery processes are usually divided into distinct pretanning, tanning and finishing operations. Because of the complexity of the chemistry involved, the substrates which are the objects of treatment in these respective circumstances differ widely in chemical constitution, and mechanical stability. For example, the water in the fresh hide may be as high as 80% in the cured hide it is reduced to about 40%, and in finished leather it remains to the extent of about 10–15%. Hence the choice of reagents for the individual stages is difficult, e.g., much work has been devoted to the development of synthetic tanning agents to replace conventional chrome or vegetable tans, but necessarily on a largely empirical basis, since their mechanisms of action are poorly understood.

Attempts to explain the relevant interactions have invoked such different phenomena as electrovalency or salt-forming and physical adsorption. Generally it is desired to effect chemical cross-linkage and therefore polymerisation within the substrate in question, thus imparting thereto hydrothermal stability with respect to shrinkage, which is necessary for example in the finished product and to prevent damage to the substrate during those steps of the tanning process which require treatment with water, and improved fixation of media superimposed thereon as required for example in post-tanning finishing operations.

Fresh skins and hides are normally salted or soaked in brine to preserve them during the period of storage prior to tanning, although some tanneries operate directly on the fresh skins.

The skins are typically cleaned and scraped to remove extraneous matter and then degreased using either solvent such as paraffin, or preferably, from ,the point of view of safety and the environment, by heating in an aqueous degreasing solution. The latter typically contains brine, but heating the skins in brine is liable to cause shrinkage. To avoid this problem, shrinkage agents, such as glutaraldehyde, are normally added to the degreasing solution.

The main operations, which are comprised by the tanning step itself, involve contacting the skins with various tannages e.g., vegetable tannages, based essentially on tanning, mineral tannages such as chrome salts or molybdenum salts, various synthetic organic tannages and combinations of the aforesaid tannages.

After tanning it is common to apply a finish to the tanned leather. This is normally a curable polymer e.g., a natural polymer such as casein or a synthetic polymer such as polyurethane. The finish is finally cured by the application of a cross linking agent. Casein finishes have hitherto been cured by the application of products such as formaldehyde.

Formaldehyde presents considerable problems on toxicological and environmental grounds, which may foreseeably lead to restrictions in its use. Substitutes for formaldehyde hitherto proposed have been substantially more expensive and generally less effective. An important object of the invention, therefore, is to provide an effective and environmentally acceptable replacement for formaldehyde in post tanning operations such as curing of finishes and especially in curing casein finishes.

A further object of the invention is to replace glutaraldehyde as an inhibitor of shrinkage during pretanning operations such as degreasing.

A third object of the invention is to offer alternatives to cross linking agents such as aziridine which have hitherto been used to cure synthetic polymer finishes on leather.

It has been proposed (e.g., U.S. Pat. No. 3,104,151 dated September 1963, U.S. Pat. No. No.2,992,897 dated July 1961) to use tetrakishydroxymethyl phosphonium chloride, in conjunction with phenols and various organic compounds of trivalent nitrogen as a tanning agent. These proposals have never, however, been put into practice and hydroxyalkyl phosphine compounds have not been found commercially useful in the tanning industry.

We have now discovered that hydroxyalkyl phosphines and phosphonium salts can be employed as chemical cross linking agents and in particular as replacement for glutaraldehyde in pretanning and as cross linking agents for finishes applied to leather after tanning.

The hydroxyalkyl phosphonium compounds have been used for many years in the production of fire retardant textiles. They are environmentally acceptable, rapidly degradable and have been shown to have lower toxicity to higher animals and plants compared to formaldehyde.

THE INVENTION

The present invention provides the use of hydroxyalkyl phosphine compounds of the formula $[HORPR'nOm]_xX_y$ wherein R is an alkyl or alkenyl group having from 1 to 24 carbon atoms, and R' may be the same or different and is an alkyl or alkenyl group having from 1 to 24 carbon atoms or an —ROH group, X is an onion such that the compound is at least sparingly soluble in water, x is the valency of X, n is 2 or 3; m is 0 or 1 such that (n+m) is 2 or 3 and y is 0 or 1 such that (n+y) is 2 or 4; or an at least sparingly water soluble condensate of any of the aforesaid compounds, for application to skins, hides or leather in pretanning or finishing operations.

According to one preferred embodiment our invention provides a method for the treatment of raw or pre-cured skins or hides prior to tanning which comprises contacting said skins or hides with an aqueous degreasing solution, characterised in that said solution contains a hydroxyalkyl phosphine compound as aforesaid.

According to a second preferred embodiment our invention provides a method of finishing tanned leather which comprises the steps of applying, thereto, successively, a curable polymeric finish and a curing agent therefor, characterised in that said curing agent is a hydroxyalkyl phosphine compound as aforesaid.

DESCRIPTION OF THE PREFERRED EMBODIMENTS

The phosphine compound may contain 2 or more phosphorus atoms, so long as the phosphine compound is water soluble to a concentration of at least 0.5 g/l at 25° C. Such phosphine compounds contain at least 1 hydroxyalkyl group, usually per phosphorus atom, and preferably at least 2 hydroxyalkyl groups per phosphorus atom. Such hydroxyalkyl groups are preferably of formula ROH, where R is as defined above. The group or groups joining the phosphorus atoms together may be of formula —R—, —R—O—R— or —R—NH—R or —R—R″—R— where R is as defined above and R″ is the residue formed by removal of two hydrogen atoms, bonded to nitrogen, from a di or polyamide or di or poly amine, such as urea, dicyandiamide, thiourea or guanidine. Such compounds with 2 or more, e.g., 3, hydroxyalkyl groups per phosphorus atom may be made by self condensation of compounds with 3 or 4 hydroxyalkyl groups attached to one phosphorus atom, e.g., of formula $[HORPRnOm]_y$ or with a compound of formula $R''H_2$ such as urea. The condensation can be performed by heating at 40°-120° C.

Preferably the phosphine compound contains only one phosphorus atom and 3 or 4 hydroxyalkyl groups especially hydroxymethyl groups. Such compounds are made by reacting phosphine with an aldehyde usually formaldehyde or a ketone in the presence of mineral acid, usually hydrochloric, sulphuric or phosphoric acid. Depending on the proportions the product may be a tris hydroxyalkyl phosphine or tetra kis (hydroxalkyl) phosphonium salt; however, the latter tends to be converted to the former under aqueous alkaline conditions with small amount of the dimeric compound with 2 phosphorus atoms and an ROR bridge and/or the phosphine oxide. The phosphorus compound usually has a pH of 1-6, when in 75% by weight aqueous solution.

The phosphorus compounds in which one or more of R are alkyl groups are made from the corresponding alkyl substituted phosphines by reaction with the aldehyde or ketone. To avoid foaming we prefer that any alkyl or alkenyl groups present should have less than 4 carbon atoms. However compounds in which 1 or 2 alkyl or alkenyl groups per molecule have up to 24 carbon atoms may be used according to our invention in applications where foaming does not present a problem.

Preferably the hydroxyalkyl phosphine compound is tris (hydroxymethyl) phosphine or a precursor or most preferably a tetrakis (hydroxymethyl) phosphonium salt. Particularly preferred are tetrakis (hydroxymethyl) phosphonium sulphate, chloride, bromide and phosphate. However X may be any compatible anion such as nitrate, fluoride, a phosphonate such as acetodiphosphonate, aminotris (methylenephosphonate), ethylenediamine tetrakis (methylenephosphonate) or diethylene triamine pentakis (methylene phosphonate), a condensed phosphate such as pyrophosphate, metaphosphate, tripolyphosphate or tetraphosphate, chlorate, chlorite, nitrite, sulphite, phosphite, hypophosphite, iodide, borate, metaborate, pyroborate, fluoborate or carbonate or an organic such as formate, acetate, benzoate, citrate, tartrate, lactate, propionate, butyrate, ethylene diamine tetracetate, paratoluene sulphonate, benzene sulphonate or a surfactant anion such as an alkyl benzene sulphonate, alkyl sulphate or alkyl ether sulphate.

Typical substrates to which the above compounds may be applied in accordance with the present invention include hides and skins from e.g., pigs, sheep, bovines, goats, reptiles, birds and fish, either raw, or, especially, substrates which have been salted or pickled (in e.g., brine). The application of said compounds to said substrates may be prior to or in conjunction with the process of aqueous degreasing, prior to the process of tanning.

Any tanning agent may be used including vegetable tannages, such as mimosa tannage, mineral tannages, such as chrome tannage e.g., using 8% chrome powder comprising 25% $Cr_2O_3$, low-chrome tannage, e.g., using 4% chrome powder comprising 25% $Cr_2O_3$, and titanium-aluminium complex tannage, resin tannages, such as melamine tannage and combination tannages in which two or more of the above tannages are applied together or in consecutive steps.

The substrates according to the present invention may comprise, in a particularly preferred embodiment, tanned skins or hides to which have been applied curable finishes, such as casein, or synthetic finishes, such as fluorocarbon or polyurethane.

In a preferred method according to the present invention, raw skins or hides, e.g., sheepskins, or especially those cured skins or hides which have been subjected to preliminary treatments following receival by the tannery, (typically those of soaking, liming, unhairing, bating and finally pickling according to conventional procedures), are contacted with a degreasing solution. The latter is typically a brine comprising from 2% to saturation e.g., from 3 to 10% typically 5 to 9% by weight of sodium chloride. According to our invention the degreasing solution also comprises a hydroxyalkylphosphine compound, especially a tetrakis hydroxymethylphosphonium salt, e.g., tetrakis hydroxymethyl phosphonium sulphate. Preferably said hydroxyalkyl phosphine compound (e.g., tetrakis hydroxymethyl phosphonium sulphate) is present in an aqueous solution of from 0.2 to 20% by weight concentration, especially 0.5 to 12% and most especially 1 to 9% by weight. The degreasing solution may also comprise additives such as detergents and wetting agents, in particular non-ionic detergents, in concentration of from 1 to 10%, e.g., 6% by weight.

In carrying out the method of the present invention, it is advantageous to keep the pH of the degreasing solution as low as possible, (although too low a pH may lower the shrinkage temperature of the treated, degreased hides or skins), such as from 1 to 9, especially from 3.5 to 8, most especially from 4.0 to 6.5 e.g., 4.5.

In a most preferred method according to the present invention, the pH of said aqueous degreasing solution is adjusted, e.g. by the addition of successive aliquots of alkali such as a soluble alkali metal or alkaline earth metal carbonate or bicarbonate, e.g., sodium bicarbonate, having a concentration of from 1 to 10%, e.g. 1 to 2% by weight.

The hydroxyalkylphosphine compound may be incorporated initially into the aqueous degreasing solution. However, in a most preferred method, the hydroxyalkylphosphine compound, e.g., tetrakishydroxymethyl phosphonium sulphate, is added as a separate component, once the pH of the reaction system comprising the skins or hides and the remainder of the species comprising the aqueous degreasing solution as hereinabove described has been adjusted to, e.g., from 4 to 8, especially from 4 to 6.5, e.g. 4.5. Typically continuous agitation is employed throughout, to effect processing of said skins or hides, for a period of, e.g., i to 2 hours, and at a temperature of from 10° to 40° C., e.g., 25° C.

Longer processing times and elevated temperatures are preferably avoided since these may lead to overprocessing of the skins or hides with a consequent reduction in tear strength of the finished tanned product. The skins or hides are typically then washed in warm water at, e.g., 50 to 60° C. until the waste liquor is clear of grease.

In a further most preferred method according to the present invention, an effective amount of a hydroxhalkylphosphine compound, especially an aqueous solution of a tetrakis hydroxymethyl phosphine salt of 1 to 10% e.g., 2% to 7.5%, especially 2.5% concentration is applied e.g., by spraying, to tanned, dried leather to which has been applied a curable finish (using methods conventionally known in the art), most especially those finishes comprising either pigmented or non-pigmented casein, or a curable resin such as polyurethane. The leather is then dried, e.g., at ambient temperature overnight, or alternatively at elevated temperatures (these being inessential for successful operation of the method) for shorter periods, such as 20 minutes at 60° C.

It is conceivable that the hydroxyalkyl phosphines of the present invention may alternatively be incorporated into the formulation of the finish prior to application thereof to the relevant substrate, however their reactivity precludes the above method in the context of some synthetic finishes.

Consequently in this context it is preferred in the method of the present invention to apply the hydroxyalkyl phosphine compounds to the surface of the substrate, e.g., leather, in the form of an afterspray.

Compositions according to the present invention may comprise hydroxyalkylphosphine compounds or solutions dissolved or emulsified respectively with liquidified solvents in pressurised containers.

The compositions may additionally comprise other chemical crosslinking agents or synergists, emulsifiers, surfactants, wetting agents and foam controlling agents.

Utility

The hydroxyalkyl phosphine compounds of the present invention are of value, inter alia, as pretanning agent to effect hydrothermal stability prior to aqueous degreasing of pickled sheepskins, thus replacing glutaraldehyde with no adverse effect on subsequent grease removal, and particularly as an afterspray to crosslink casein finishes for leather, thus replacing formaldehyde, with no adverse effects on performance characteristics such as rubfastness, abrasion resistance and adhesion.

The invention will be further illustrated by the following examples, in which THPS means tetrakis(hydroxymethyl) phosphonium sulphate, and all percentages are based on total weight of solution.

EXAMPLE 1

Aqueous degreasing with THPS

Matched sides of sheepskins were processed using the following conventional process:

1.0 liter water at room temperature
450 g lime
150 g sodium sulphide
Apply ½ liter per side
Paint flesh side
Leave 5 hours. Pull wool
Re-weigh
100% water
1% lime
1% sodium sulphide
Run intermittently overnight
100% water at room temperature
10% salt
Wash 5 minutes
5% ammonium sulphate
Run 30 minutes
100% water
Run 1 hour to give pH 8.7
100% water at 35° C.
0.1% of the proteolytic enzyme system sold under the Registered Trade Mark
PANCREOL IQA
Run 1 hour
Wash in cold water for 10 minutes
100% water at room temperature
10% salt
Run 10 minutes
1% formic acid (diluted 1:10 with water)
0.5% sulphuric acid (diluted 1:10 with water)

Degreasing of the pickled skins was then carried out using the process set out below:

40% water at 25° C.
8% salt
6% of the nonionic detergent sold under the Registered Trade Mark SANDOZIN NI
Run 30 minutes
Add 2% sodium formate
Run 15 minutes
Add 1.2% sodium bicarbonate in 3 aliquots, one aliquot every 15 minutes
pH 4.55 minutes after last addition
Run a further 30 minutes
Add 1% aqueous THPS (75%)
Run 45 minutes
Add 1.2% sodium bicarbonate in 3 aliquots, one aliquot every 15 minutes pH
2nd addition 4.6
3rd addition 6.2
Drain
Wash in water at 53° C.
Run 30 minutes
Repeat wash five times until waste liquor is clear of grease For comparative purposes, degreasing was also carried out as set out above except replacing THPS with 3% of the proprietary glutaraldehyde product sold under the Registered Trade Mark RELUGAN GTW, and using paraffin as set out below.

Paraffin degreasing process
100% paraffin at 35° C.
Run 1 hour
Drain
100% water at 30° C.
10% salt
1% nonionic detergent
Run 30 minutes
Drain
Repeat detergent wash 4 times The treated, degreased samples were then tested for shrinkage temperature and grease removal. The results are given in Tables 1 and 2 respectively.

TABLE 1

The effect of the degreasing procedures on shrinkage temperature

| Treatment | Final pH | SHRINKAGE TEMPERATURE (°C.) Full Substance | Grain | Flesh |
|---|---|---|---|---|
| Paraffin | — | 68 | — | — |
| THPS | 6.6 | 77 | 79 | 76 |
| Glutaraldehyde | 6.5 | 82 | 83 | 82 |

TABLE 2

Analysis of grease removal on matched side (duplicate results)

| Treatment | THPS | Glutaraldehyde | Paraffin |
|---|---|---|---|
| grease in skin after degreasing (%) | 5.1 | 5.1 | 5.1 |
| average grease removal (5) | 66 | 64 | 67 |

The results show that under these conditions the removal of grease using THPS is as good as that using glutaraldehyde and paraffin treatments respectively.

Samples of each type of treatment were then treated by the standard chrome tanning process, and tested for their tear strength. The results are given in Table 3.

TABLE 3

Tear strength of chrome tanned leathers with the different degreasing methods

| Pretreatment | Tear Strength (kg/mm) Perpendicular to backbone | Parallel to backbone | Average |
|---|---|---|---|
| Control* | 5.23 ± 0.51 | 5.85 ± 1.88 | 5.55 ± 1.20 |
| Glutaraldehyde | 3.89 ± 0.57 | 4.39 ± 1.09 | 4.14 ± 0.82 |
| THPS | 3.93 ± 1.04 | 4.77 ± 1.58 | 4.35 ± 1.31 |

*Paraffin degreased

Analysis of the results shows that there is no significant difference between the treatments. Whilst they are both weaker than the control a reduction in tear strength occurs with all types of tanning. The results suggest the THPS has no greater effect on the tear strength than does the glutaraldehyde. The differences in the shrinkage temperatures with standard chrome processing is minimal and the colour produced is also satisfactory in comparison to paraffin degreased control.

EXAMPLE 2

Casein Fixation with THPS

Experimental variables:

1[ Leather type Chrome
  Chrome tanned sheepskin
  Vegetable tanned calfskin
2[ Pigmentation
  Pigmented
  Non-pigmented casein finishes
3[ Fixative
  0.2,5,10% aqueous THPS
  0% formaldehyde controls
4[ Drying temperature after fixation
  Ambient
  20 mins at 60° C.

Method

Samples of each leather were sprayed with two coats of Mix A with intermediate drying and then sprayed with two coats of Mix B and dried.

| | Mixture A | B |
|---|---|---|
| Earnshaw paste top (casein binder 14% solids) | 70 | 70 |
| Earnshaw PPE white (anatase titanium dioxide pigment, 52% solids) | 10 | 0 |
| Water | 70 | 70 |

The fixation was applied as a light spray coat and dried at 60° C. for 20 minutes or left to dry at ambient temperature. Non-pigmented samples were prepared using Mix B throughout. All samples were left at 20° C. 65% rH for 2 days before glazing and stored for one week at the same conditions before testing. Assessment was then made of any yellowing, odour and wet rubfastness.

Results

No samples showed any signs of yellowing or had any noticeable smell. The number of wet rubs to a grey scale contract of 3 (SLF 5) was assessed, all samples with no fixation failed at 8 wet rubs, whilst all samples fixed with THPS or formaldehyde passes at >1024 wet rubs.

Drying temperatures made no difference to sample performance in this experiment.

The results show that THPS applied at a level of 2.5% fixes casein with a performance equivalent to 10% formaldehyde.

EXAMPLE 3

Casein Formulations

A selection of commercial casein products were applied to leather followed by post-treatment with THPS or formaldehyde.

Samples of vegetable-tanned goat skins were finished with each of the following products (Earnshaws), whose properties are further described in Table 4 below.

1) Lustre
2) Plating season
3) Paste top
4) Binder 1079
5) Glazing binder
6) Hard binder
7) Top finish GP
8) 7% Paste Top The finish consisted of two pigmented base coats and two top coats.

Each sample was post-treated with

1) No fixative
2) 5% solution of 70% active THPS plus anionic surfactant minimum quantity
3) 10% formaldehyde The samples were tested for resistance to wet rub before and after artificial ageing in an incubator at 60° C. for 1 month.

The results are shown below in Tables 4 to 6.

In all cases the results for THPS are better than or equivalent to formaldehye.

TABLE 4

| CASEIN BINDER | NAME | PROPERTIES (Sprayed at 5% solids) |
|---|---|---|
| | | Range of casein binders included: |
| 1 | Lustre | Soft casein & wax |
| 2 | Plating Season | Soft plasticised casein & silicon |
| 3 | Paste Top | General casein binder |
| 4 | Binder 1079 | Plasticised casein, soft pleasant handle |
| 5 | Glazing Binder | Hard plasticised casein, not recommended for use alone |
| 6 | Hard Binder | Hard casein, not recommended for use alone |
| 7 | Top Finish GP | Medium hard casein & shellac & wax |
| 8 | 7% Paste Top | General casein binder at 7% solids |

TABLE 5

| CASEIN BINDER | NAME | CONTROL | 10% FORMALDEHYDE | 5% THPS SOLUTION (70% ACTIVE) |
|---|---|---|---|---|
| | | Wet rub fastness (number of rubs to grey scale 3): | | |
| 1 | Lustre | 8 | 64 | 128 |
| 2 | Plating Season | 8 | 1024 | 1024 |
| 3 | Paste Top | 8 | 2048 | 2048 |
| 4 | Binder 1079 | 8 | 256 | 512 |
| 5 | Glazing Binder | 8 | 1024 | 1024 |
| 6 | Hard Binder | 16 | 512 | 1024 |
| 7 | Top Finish GP | 16 | 512 | 2048 |
| 8 | 7% Paste Top | 8 | 2048 | 2048 |

TABLE 6

| CASEIN BINDER | NAME | CONTROL | 10% FORMALDEHYDE | 5% THPS SOLUTION (70% ACTIVE) |
|---|---|---|---|---|
| | | Glazing quality: | | |
| 1 | Lustre | * | ** | **** |
| 2 | Plating Season | **** | **** | **** |
| 3 | Paste Top | ** | **** | **** |
| 4 | Binder 1079 | ** | *** | **** |
| 5 | Glazing Binder | *** | **** | **** |
| 6 | Hard Binder | **** | **** | **** |
| 7 | Top Finish GP | *** | **** | **** |
| 8 | 7% Paste Top | **** | **** | **** |

* No
** Just
*** Could be better
**** Yes

We claim:

1. A method of treating skins which comprises contacting said skins for a period of time from one to two hours at a temperature of from 10° to 40° C. prior to tanning with an aqueous degreasing solution consisting essentially of brine and an effective amount of a shrink inhibitor, wherein said shrink inhibitor is (a) at least one hydroxyalkyl phosphine compound of the formula $$(HORPR_n^1O_m)_xX_y$$

wherein:

R is an alkylene having 1 to 24 carbon atoms or an alkenylene group having from 1 to 24 carbon atoms;

$R^1$ is an alkyl group having 1 to 24 carbon atoms, an alkenyl group having from 1 to 24 carbon atoms or a —ROH group;

X is an anion, whereby said hydroxyalkyl phosphine compound is soluble in water;

x is a whole number equal to the valency of X;

n=2 or 3 and m=0 or 1, whereby (n+m)=2 or 3;

y=0 or 1, whereby (n+y)=2 or 4; or (b) a condensate of at least one of said compound (a), said condensate being water-soluble.

2. The method of claim 1 in which said hydroxyalkyl phosphine compound is present as an aqueous solution of from 0.2 to 20% by weight concentration.

3. The method of claim wherein sodium chloride is present in said aqueous degreasing solution at a concentration from 2% by weight to saturation.

4. The method of claim 1, in which each of said alkyl and said alkenyl groups has from 1 to 4 carbon atoms.

5. The method of claim 1 in which $R^1$ is an —ROH group.

6. The method of claim 5 in which R is a methylene group.

7. The method of claim 1 in which said hydroxyalkyl phosphine compound is a water soluble tetrakis (hydroxymethyl)phosphonium salt.

8. The method of claim 7 wherein said salt is a sulphate, chloride or phosphate.

9. The method of claim 7, wherein said alkyl group, said alkenyl group, said alkylene group and said alkenylene group, have 1 to 4 carbon atoms.

10. The method of claim 7, wherein the hydroxyalkyl phosphine compound is water soluble to a concentration of at least 0.5 g/l at 25° C.

11. The method of claim 7, wherein the hydroxyalkyl phosphine compound is tetrakis (hydroxymethyl) phosphonium sulphate, chloride, bromide or phosphate and wherein sodium chloride is present in said aqueous degreasing solution at concentration of 3 to 10 weight %.

12. The method of claim 11, wherein sodium chloride is present in said aqueous degreasing solution at concentration of 5 to 9 weight %.

13. The method of claim 12, wherein the hydroxyalkyl phosphine compound is present in the aqueous degreasing solution in a concentration of 0.5 to 12 weight %.

14. The method of claim 12, wherein the hydroxyalkyl phosphine compound is present in the aqueous degreasing solution in a concentration of 1 to 9 weight %.

15. The method of claim 14, wherein the aqueous degreasing solution has a pH of 1 to 9.

16. The method of claim 14, wherein the aqueous degreasing solution has a pH of 3.5 to 8.

17. The method of claim 14, wherein the aqueous degreasing solution has a pH of 4.0 to 6.5.

* * * * *